US009732475B2

(12) United States Patent
Tosas Fuentes et al.

(10) Patent No.: US 9,732,475 B2
(45) **Date of Patent: *Aug. 15, 2017**

(54) COMPOSITION FOR COATING A PAPER WRAPPER FOR SMOKING ARTICLES

(75) Inventors: Agustin Tosas Fuentes, Barcelona (ES); Pablo De Mariscal Ruigomez, Barcelona (ES)

(73) Assignee: MIQUEL Y COSTAS & MIQUEL, S.A., Barcelona (ES)

( * ) Notice: Subject to any disclaimer, the term of this patent is extended or adjusted under 35 U.S.C. 154(b) by 0 days.

This patent is subject to a terminal disclaimer.

(21) Appl. No.: 14/113,404

(22) PCT Filed: Apr. 3, 2012

(86) PCT No.: PCT/ES2012/070225

§ 371 (c)(1),
(2), (4) Date: Feb. 5, 2014

(87) PCT Pub. No.: WO2012/168516

PCT Pub. Date: Dec. 13, 2012

(65) Prior Publication Data

US 2014/0144454 A1 May 29, 2014

(30) Foreign Application Priority Data

Jun. 9, 2011 (ES) ..... 201130968

(51) Int. Cl.
*A24D 1/02* (2006.01)
*B41M 3/00* (2006.01)
*D21H 23/22* (2006.01)

(52) U.S. Cl.
CPC ..... *D21H 23/22* (2013.01); *A24D 1/02* (2013.01); *A24D 1/025* (2013.01); *B41M 3/006* (2013.01)

(58) Field of Classification Search
USPC ..... 162/135, 139, 158, 175, 178, 162/181.1–181.2, 181.4–181.5, 181.8, 162/184; 106/217.01, 205.1; 427/256, 427/286
See application file for complete search history.

(56) References Cited

U.S. PATENT DOCUMENTS

| | | | | |
|---|---|---|---|---|
| 3,048,995 | A | 8/1962 | Browning | |
| 4,615,345 | A | 10/1986 | Durocher | |
| 5,092,353 | A | 3/1992 | Montoya et al. | |
| 5,392,793 | A * | 2/1995 | Molloy | 131/339 |
| 5,534,114 | A * | 7/1996 | Cutright et al. | 162/139 |
| 5,849,153 | A * | 12/1998 | Ishino et al. | 162/135 |
| 5,878,754 | A | 3/1999 | Peterson et al. | |
| 7,677,256 | B2 | 3/2010 | Chapman et al. | |
| 8,500,895 | B2 * | 8/2013 | Blank | B41M 5/30 106/31.32 |
| 2003/0178039 | A1 * | 9/2003 | White et al. | 131/365 |
| 2004/0099279 | A1 * | 5/2004 | Chapman et al. | 131/365 |
| 2005/0000528 | A1 * | 1/2005 | Bereman | 131/334 |
| 2005/0005947 | A1 | 1/2005 | Hampl, Jr. et al. | |
| 2005/0016556 | A1 * | 1/2005 | Ashcraft et al. | 131/365 |
| 2005/0076925 | A1 * | 4/2005 | Fagg et al. | 131/60 |
| 2007/0246055 | A1 * | 10/2007 | Oglesby | 131/365 |
| 2009/0288671 | A1 | 11/2009 | White et al. | |
| 2009/0301503 | A1 | 12/2009 | Peter et al. | |
| 2012/0152266 | A1 | 6/2012 | Volgger | |
| 2014/0342083 | A1 * | 11/2014 | Wu | H01K 1/00 427/126.1 |

FOREIGN PATENT DOCUMENTS

| | | | |
|---|---|---|---|
| CN | 101437415 | | 5/2009 |
| DE | 1 936 547 | | 1/1971 |
| EP | 1 403 432 | | 3/2004 |
| EP | 1 166 656 | | 11/2005 |
| GB | 1483495 | * | 8/1977 |
| WO | 03/015543 | | 2/2003 |
| WO | 2007/104908 | | 9/2007 |
| WO | 2008/116739 | | 10/2008 |
| WO | 2010/149380 | | 12/2010 |

OTHER PUBLICATIONS

Tripotassium Citrate, Chemical Book, no date, [online], retrieved from the Internet, [retrieved Feb. 20, 2015] <URL: http://www.chemicalbook.com/ChemicalProductProperty_EN_CB4134347.htm>.*

Handbook for Pulp and Paper Technologists, 2nd ed, Angus Wilde Publications, 1992, pp. 350-354.*

International Search Report issued Jul. 4, 2012 in International (PCT) Application No. PCT/ES2012/070225.

European Office Action in corresponding application EP 2719293 of Mar. 22, 2016.

* cited by examiner

*Primary Examiner* — Dennis Cordray
(74) *Attorney, Agent, or Firm* — Wenderoth, Lind & Ponack, L.L.P.

(57) ABSTRACT

The present invention relates to a composition for coating paper wrapper for smoking articles, which comprises a combination of gum arabic, preferably between 40% and 95% by weight with respect to the total dry material weight of the composition, and a filler that comprises calcium carbonate, preferably in an amount of at least 5% by weight with respect to the dry material weight of the composition, alone or in combination with other substances such as, for example, kaolin, calcium sulphate, titanium dioxide and mixtures thereof, and to the use thereof for producing a paper wrapper for smoking articles.

20 Claims, 1 Drawing Sheet

COMPOSITION FOR COATING A PAPER WRAPPER FOR SMOKING ARTICLES

FIELD OF THE INVENTION

The present invention falls into the field of the technology of paper wrapper for smoking articles.

BACKGROUND OF THE INVENTION

Cigarette manufacturers increasingly require that the cigarettes with little tendency to ignition meet the legal requirement in the United States that 75% of them extinguish on a support normally consisting of 10 sheets of a particular filter paper type. This percentage of cigarettes that extinguish is measured in the United States through the self-extinguishment test or "SE" for its acronym in English, Self-Extinguishment, ASTM E2187, the only official test currently available.

But in addition, cigarette manufacturers also require the percentage of cigarettes that extinguish during free combustion, that is, without being in contact with anything, to be minimal and, ideally, zero. This is measured using an unofficial test called "FASE" for its acronym in English, Free-Air Self-Extinguishment.

The basis of the measurement of the FASE value is to determine the percentage of cigarettes that burn out completely after lighting them and smoking them for 5 mm (normally in a cigarette smoking machine) and holding them by the filter without touching anything more inside a glass cabinet or similar, where the air circulation is kept as low as possible, to ensure total removal of the smoke from the combustion (this parameter depends on the volume of the glass cabinet, but for the case of a glass cabinet where there is installed a cigarette smoking machine, this flow rate is around 0.5 liter/minute).

There is abundant state of the art on methods to obtain self-extinguishing cigarettes, such as the patent application WO2003/15543. The use of the gum arabic has meant an important contribution in the obtainment of self-extinguishing cigarettes, but it was necessary to improve the filler of the film forming composition replacing the aluminium hydroxide by compounds that increase the percentage of cigarettes that do not extinguish at free combustion.

Calcium carbonate is mentioned in patents as U.S. Pat. No. 4,615,345 but not in the sense of reducing the FASE value comparatively to aluminium hydroxide.

Patent EP1166656 B1 discloses the use of calcium carbonate as the filler with a particle size of 1.3 μm and with different forms. However it is not combined with gum arabic either. Something similar happens in the patent application EP1403432, which discloses the use of calcium carbonate with particle size of diameter less than 1.3 μm.

On the other hand, application US20030178039 mentions gum arabic among possible forming film materials for a composition applicable to papers dispersible in water, as well as calcium carbonate as possible filler in said composition. In addition, both substances are not listed as a specific combination, so there is no incentive for the express combination of both substances. Therefore, the differences between this application and the present invention are: (1) while the new composition object of this application is directed to the so-called "cigarette paper", the application US20030178039 is directed only to the plug wrap and tipping paper; (2) the object of the present invention is the extinction of the cigarettes, while the object the application US20030178039 is to promote the dispersibility in water of the filter papers and mouthpiece.

With the paper obtained according to the present invention lowering the FASE value for a given SE value comparatively to aluminium hydroxide is achieved, as it will be shown below.

OBJECT OF THE INVENTION

The present invention has as an object a composition for coating paper wrapper for smoking articles which comprises a combination of gum arabic and calcium carbonate that provides the advantage of obtaining self-extinguishing cigarettes with a lower percentage of self-extinguishment during free combustion than using aluminium hydroxide.

The method of the invention allows providing a paper for cigarettes, preferably by the internal side or in contact with the tobacco, with a coating suitable for keeping the FASE parameter with the lowest possible value. Said coating can be applied in discrete areas separated from each other through areas without coating, or continuously, with the use of common printing techniques. Said coating composition is obtained from a solution prepared based of gum arabic or acacia gum, with a filler that contains at least calcium carbonate. Other mineral fillers that also are useful for this purpose, and that could be used in combination with calcium carbonate, are kaolin, calcium sulphate, titanium dioxide, etc. Combustion agents such as citrate, preferably trisodium and tripotassium, alone or combined with each other can also be added to the composition.

Throughout this specification the terms "composition" and "ink" are used interchangeably. When referring to the composition in dry material, it is expressly stated. In addition, the expressions "with respect to the dry material" and "with respect to solids" or "with respect to the solids" are also used interchangeably.

DESCRIPTION OF THE INVENTION

The present invention is related in the first place to a composition for coating paper wrapper for smoking articles which comprises a combination of gum arabic and a filler which comprises calcium carbonate, alone or in combination with other substances.

According to particular embodiments of the composition for coating paper wrapper for smoking articles the filler may comprise calcium carbonate in combination with other substances selected from kaolin, calcium sulphate, titanium dioxide and mixtures thereof.

According to additional particular embodiments of the composition for coating paper wrapper for smoking articles, the filler may comprise calcium carbonate in combination with citrate, preferably trisodium and tripotassium citrate.

The gum arabic is present in the composition in a percentage preferably comprised between 40% and 95% by weight, with respect to the total weight of dry material, more preferably between 45 and 90% by weight, even more preferably between 50 and 80% by weight with respect to the total weight of dry material of said composition.

The rest of the coating composition is at least calcium carbonate, alone or in combination with other substances. According to the present invention, the percentage of calcium carbonate on the dry material of the composition is of at least 5% by weight, and it is present in this composition in an amount between 5 and 60% by weight with respect to the total dry weight of the composition, preferably of between 10 and 55% by weight, and more preferably of between 20 and 50% by weight.

A especially preferred coating composition is a composition or ink that has a content in dry material of between 25 and 40% by weight with respect to the total weight of the composition, and in which said dry material comprises:

67% by weight of gum arabic with respect to the dry material and 33% by weight, of calcium carbonate with respect to the dry material.

The composition is applied in liquid form to the paper wrapper of the smoking article.

With this amount of calcium carbonate the following benefits are obtained:

The visibility of the printed band by the side opposite to the printing is lower.

The diffusivity value to achieve the desired value of extinction of the cigarettes according to the ASTM E2187 test is higher when using calcium carbonate than when using aluminium hydroxide according to the patent application WO2003/15543 and, therefore, using calcium carbonate reduces the content of tar, nicotine and carbon monoxide, a key factor to the fulfilment of the European legislation in force.

An additional embodiment of the composition, also preferred, is a composition having a content of dry material of between 25 and 40% by weight with respect to the total weight of the composition and comprising:

between 40% and 95% of gum arabic with respect to the dry material weight, between 5 and 60% by weight of calcium carbonate with respect to the dry material weight.

An additional embodiment of the composition, also preferred, is a composition having a content of dry material of between 25and 40% by weight with respect to the total weight of the composition and comprising:

between 40% and 95% by weight of gum arabic with respect to the dry material weight, between 5 and 60% by weight, of calcium carbonate with respect to the dry material weight.

between 2.5% and 4% by weight, of a combustion agent selected from trisodium citrate, tripotassium citrate and mixture of both, preferably, approximately 3.5% by weight with respect to the dry material weight.

The diffusivity value to achieve a correct extinguishment value of the cigarettes according to the ASTM E2187 test is higher the higher the percentage of calcium carbonate is on the weight by solids in the ink, making it preferable to use an ink with high levels of calcium carbonate.

With respect to the measurement of the diffusivity (also called diffusion coefficient or capacity), although there is not a standard method for measuring it, its foundation consists of the following: the paper sample is placed between two chambers. In one of them there is a constant nitrogen flow and in the other the same flow of carbon dioxide. There is no difference in pressure between both chambers. The nitrogen is diffused through the paper towards the carbon dioxide stream and vice versa. The concentration of carbon dioxide at the exit of the chamber where nitrogen flows is continuously measured, this concentration being the one used for the calculation of the diffusivity of the sample.

The present invention also has as object the use of the described composition to partially or fully coat a paper wrapper for smoking articles. The composition can be applied by printing by means of a technique selected from flexography, rotogravure, screen printing and offset.

The composition can be applied on a paper wrapper for smoking articles as a partial coating, in the form of bands parallel to each other and arranged perpendicularly to the axis of the smoking article or with a slight deviation of said axis, for example at an angle of between 0.5° and 5° approximately with respect to the perpendicular of the axis of said smoking article. Said bands parallel to each other, may have a width of between 4and 10 mm, and preferably between 6 and 8 mm. The bands parallel to each other may be separated by a distance of between 10 and 30 mm, and they are preferably separated by a distance of between 15 and 25 mm.

Said composition can be applied to the paper wrapper for smoking articles in amounts comprised between 0.5 and 10 grams of dry material per square meter of paper, and preferably between 0.9 and 8 grams of dry material per square meter of paper, measured in the printed area.

For the application of the composition standard printing techniques, such as flexography, rotogravure, screen printing and offset can be used, although it is preferred to use flexography continually or in bands, with the use of a transfer roller designed for a proper transfer of said composition to the paper wrapper for a smoking article. In accordance with the invention, this composition should be applied to said paper in amounts comprised in the range of between 0.5 and 10 grams of dry material per square meter of paper, and more preferably between 0.9 and 8 grams of dry material per square meter of paper, measured in the printed area.

A very important parameter to be considered when printing a paper using any technique is the viscosity of the composition. There is a limit of viscosity in rotogravure and flexography above which the transfer of the composition to the support to be printed becomes difficult. Based on our experience, viscosities between 80 and 600 cps, measured with a viscometer Brookfield RVT at room temperature, 20 rpm and with the suitable rod for these viscosity values, are the most appropriate.

The paper air permeability is measured in ml/min/cm$^2$, at a pressure drop of 1 kPa, as described in the standard method CORESTA n° 40. For this reason, this unit is commonly called Coresta Unit, or CU.

The initial permeability of the paper can be 19 CU or higher, for example, 150 CU. The fibres that make up the paper can be wood-based or others, as is the case of the annual plants flax, hemp, esparto, jute and others. These papers have weights of for example between 19 and 40 g/m$^2$, preferably of between 20 and 30 g/m$^2$.

The present invention has in addition as an object a paper wrapper for smoking articles which comprises the composition described above.

A particular embodiment of the paper wrapper for smoking article with low propensity to ignition is a wrap comprising, at least, areas coated with an ink composed by:

a percentage of dry material of between 25 and 40% by weight with respect to the total composition, between 40% and 95% by weight of gum arabic with respect to the dry material weight, between 5 and 60% by weight, of calcium carbonate with respect to the dry material weight. and preferably, having an initial air permeability of between 10 CU and 150 CU.

An additional particular embodiment of the paper wrapper for smoking article with low propensity to ignition is a wrap comprising, at least, areas coated with an ink composed by:

a percentage of dry material of between 25 and 40% by weight with respect to the total composition, between 40% and 95% by weight of gum arabic with respect to the dry material weight, between 5 and 60% by weight, of calcium carbonate with respect to the dry material weight, between 2.5% and 4% by weight, of a combustion agent selected from trisodium citrate, tripotassium citrate and mixture of both, preferably, approximately 3.5% by weight with respect to the dry material weight, and preferably, having an initial air permeability of between 10 CU and 150 CU.

The present invention has in addition as an object a smoking article, preferably a cigarette, which comprises the paper wrapper for smoking article described above.

Throughout the present specification the word "ink" and the expression "coating composition" should be considered synonymous and are used interchangeably.

EXAMPLES OF EMBODIMENT

Preparation of a Coating Composition

The preparation of a composition according to the invention is described in the patent application WO2003/15543.

Such composition is prepared by dissolving a predetermined amount of gum arabic or acacia gum in water in concentrations that vary between 40 and 95% by weight with respect to the total weight of dry material of the composition, preferably between 45 and 90% by weight, more preferably between 50 and 80% by weight, and even more preferably between 60 and 68% by weight, the rest of solids being calcium carbonate at least. Water is added until completing 100% by weight.

The preparation of the coating liquid ink, or composition, is made by mixing the appropriate amounts of a solution of gum arabic in water at 39% and calcium carbonate in the suitable system to achieve a good dispersion of the calcium carbonate (normally, said system are stirrers with an important shear component such as for example, a Silverstone stirrer), adding at the end the required amount of water to adjust the suitable concentration of dry material.

This concentration of dry material depends basically on two factors:

the printing parameters, which in flexography is mainly the volume of anilox roller the diffusivity and/or the air permeability of the paper wrapper for smoking articles to be printed. The diffusivity and/or the air permeability of the paper wrapper for smoking articles are not parameters that strictly measure the same, although they are related for a specific sample of paper wrapper for smoking articles.

Example of application of the coating composition and analysis of the influence of the type of filler.

To determine the working limits with our technology, we have started from an ink consisting of 67% by weight of dry material of gum arabic, and 33% by weight with respect to dry material, of filler at several levels of content in solids, this filler being aluminium hydroxide with a particle size of 1.2 microns in one case and calcium carbonate precipitated with a particle size of less than 1 micron in the other. With this composition there have been printed bands with different weights on a paper wrapper for smoking articles manufactured with wood fibres and with an air permeability of 50 CU.

Specific Application Mode of the Composition to the Wrap

The layer of ink or coating composition was printed with a central drum flexographic machine, using a 30 cc/m$^2$ anilox and a 2.54 mm etching plate.

The diffusivity of the bands printed has been analyzed and cigarettes have been manufactured using tobacco of a typical "American blend". The cigarettes have been analyzed according to the ASTM E2187 method for determining their extinguishment on a filter paper support (SE). Likewise their free combustion extinguishment (FASE) has been determined.

Figure 1:
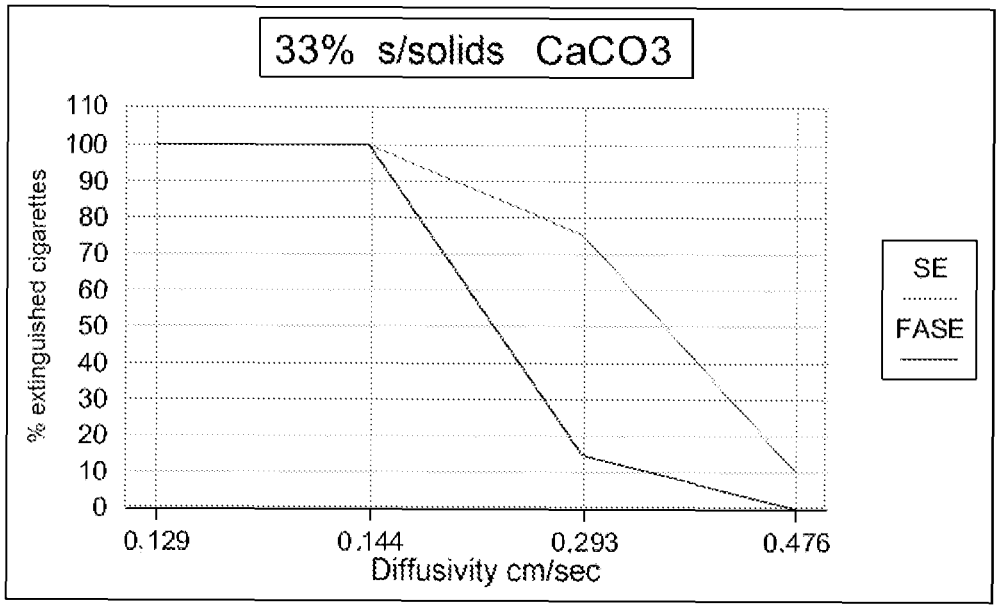
FIG. 1 shows the results obtained of percentage of extinguished cigarettes, measured according to ASTM E2187 (SE) and according to the parameter of free combustion extinguishment (FASE), against the diffusivity values, for cigarettes with a filler exclusively of calcium carbonate.
Figure 2:
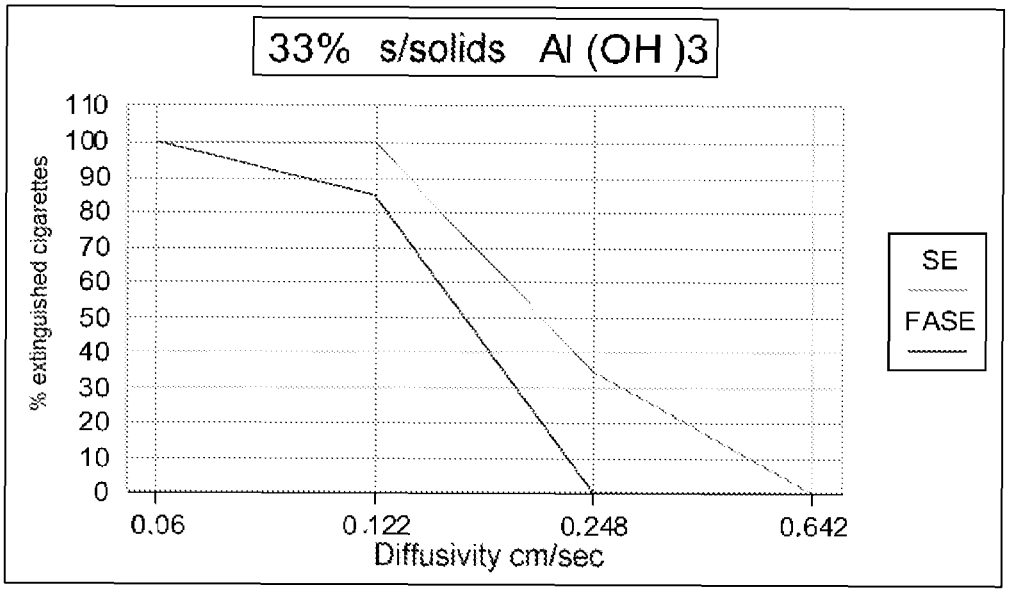
FIG. 2 shows the results obtained of percentage of extinguished cigarettes, measured according to ASTM E2187 (SE) and according to the parameter of free combustion extinguishment (FASE), against the diffusivity values, for cigarettes with a filler exclusively of aluminium hydroxide.

FIGS. 1 and 2 show the results of percentage of extinguished cigarettes measured according to the self-extinguishment (SE) parameter and according to the free combustion extinguishment (FASE) parameter, against the diffusivity values, for cigarettes with a filler exclusively of calcium carbonate (FIG. 1) and for cigarettes with a filler exclusively of aluminium hydroxide (FIG. 2).

Taking into account that the objectives are to obtain a minimum of 75% of cigarettes extinguished on support (% SE) and a FASE value as low as possible, this study shows that the values of % FASE for this value of 75% SE are substantially lower using calcium carbonate than using aluminium hydroxide (approximately, 50% FASE with aluminium hydroxide and 15% with calcium carbonate). In addition, the range of diffusivity values to obtain at least 75% of SE is greater for the case of calcium carbonate (0 to 0.293 cm/sec) than for the case of aluminium hydroxide (0 to 0.172 cm/sec).

Example of a Cigarette Wrap According to the Invention

Although any paper wrapper for smoking articles, as is the case of those having a permeability to air comprised between 15 and 150 CU, is useful for the object of the present invention, for demonstration purposes in the following table are indicated the characteristics of the paper used in the following tests:

TABLE 1

Characteristics of the paper wrapper for smoking articles:

| TYPE OF PAPER | VERGE EXTRA 824 N-50_CO |
|---|---|
| WEIGHT g/m$^2$ | 25.5 |
| ASHES, % | 17.0 |
| POROSITY, CU | 49.1 |
| STREGTH, g/15 mm | 1400 |
| ELONGATION, % | 1.4 |
| COMBUSTION ADDITIVES * | 0.70 |

* percentage of citric acid monohydrate

What is defined as ashes is a measure of the content of mineral filler of the paper, which in the case of the paper wrapper for smoking articles, is normally calcium carbonate. The experimental factor by which this value has to be multiplied to obtain the percentage of calcium carbonate is 1.695.

The data of composition of the ink, layer weight applied, together with the diffusivity measured in the band and the SE and FASE values of the cigarettes manufactured with these papers are shown in tables 2 and 3, in the following.

TABLE 2

| Composition with aluminium hydroxide: | | | | |
|---|---|---|---|---|
| Ink composition (% by weight) | Layer Weight, $g/m^2$ | Diffusivity, cm/sec | % SE | % FASE |
| 25% Gum arabic 12.4% aluminium hydroxide | 4.4 | 0.06 | 100 | 100 |
| 20% Gum arabic 9.9% aluminium hydroxide | 3.4 | 0.122 | 100 | 85 |
| 16% Gum arabic 7.9% aluminium hydroxide | 2.5 | 0.248 | 35 | 0 |
| 12.1% Gum arabic 5.9% aluminium hydroxide | 1.7 | 0.642 | 0 | 0 |

TABLE 3

| Composition with calcium carbonate: | | | | |
|---|---|---|---|---|
| % by weight, in the composition | Layer Weight, $g/m^2$ | Diffusivity, cm/sec | % SE | % FASE |
| 25% Gum arabic 12.4% calcium carbonate | 3.9 | 0.129 | 100 | 100 |
| 20% Gum arabic 9.9% calcium carbonate | 3.2 | 0.144 | 100 | 100 |
| 16% Gum arabic 7.9% calcium carbonate | 2.5 | 0.293 | 75 | 15 |
| 12.1% Gum arabic 5.9% calcium carbonate | 1.7 | 0.476 | 10 | 0 |

In all the cases, the percentages of gum arabic and calcium carbonate on dry material are 67% and 33% respectively. The percentage of dry material of the ink used in the printing varies.

FIGS. 1 and 2 show the relationship between diffusivity of the band and the SE and FASE percentages for each type of filler.

It is very difficult to achieve predetermined SE values, so inks with various contents of dry material are prepared keeping the relationship between gum arabic and filler, and it is interpolated.

The invention claimed is:

1. A composition for coating paper wrappers for smoking articles, consisting of water, between 40% and 95% by weight of gum arabic with respect to the total dry material weight of the composition, and between 5 and 60% by weight of calcium carbonate with respect to the total dry material weight of the composition, wherein the composition has a viscosity of between 80 and 600 cps, measured with a Brookfield RVT viscometer at room temperature, and wherein a smoking article comprising a paper wrapper coated with the composition is self-extinguishing and has an SE value equal or higher than 75% and a FASE value equal or lower than 15%.

2. A method of coating a paper wrapper for a smoking article comprising applying a composition as a total or partial coating of a paper wrapper that wraps the tobacco rod of the smoking article, wherein the composition comprises gum arabic and a filler, wherein the filler comprises calcium carbonate alone or in combination with substances selected from the group consisting of kaolin, calcium sulphate, citrate, titanium dioxide and mixtures thereof, wherein the composition comprises:

between 40% and 95% by weight of gum arabic with respect to the total dry material weight of the composition, and between 5% and 60% of calcium carbonate with respect to the total dry material weight of the composition, wherein the composition has a viscosity of between 80 and 600 cps, measured with a Brookfield RVT viscometer at room temperature, wherein the composition is applied by printing by means of a technique selected from the group consisting of flexography and rotogravure, and wherein the composition provides a self-extinguishing smoking article having an SE value equal or higher than 75% and a FASE value equal or lower than 15%.

3. The method of claim 2, wherein the composition is applied on a paper wrapper that wraps the tobacco rod of the smoking article as partial coating, in the form of bands parallel to each other and arranged perpendicularly to the longitudinal axis of the smoking article.

4. The method of claim 2, wherein the composition is applied on a wrapper that wraps the tobacco rod of the smoking article paper as partial coating, in the form of bands parallel to each other and arranged at an angle of between 0.5° and 5°, approximately with respect to the perpendicular of the longitudinal axis of the smoking article.

5. The method of claim 4, wherein the bands parallel to each other have a width of between 4 and 10 mm.

6. The method of claim 4, wherein the bands parallel to each other have a width of between 6 and 8 mm.

7. The method of claim 4, wherein the bands parallel to each other are separated by a distance of between 10 and 30 mm.

8. The method of claim 4, wherein the bands parallel to each other are separated by a distance of between 15 and 25 mm.

9. The method of claim 2, wherein the composition is applied by printing the paper wrapper that wraps the tobacco rod of a smoking article in amounts comprised between 0.5 and 10 grams of dry material per square meter of paper, measured in the printed area.

10. The method of claim 2, wherein the composition is applied by printing the paper wrapper that wraps the tobacco rod of the smoking article in amount comprised between 0.9 and 8 grams of dry material per square meter of paper, measured in the printed area.

11. The method of claim 2, wherein the composition comprises between 45% and 90% by weight of gum arabic with respect to the total dry material weight of the composition.

12. The method of claim 2, wherein the composition consists of water, between 40% and 95% by weight of gum arabic with respect to the total dry material weight of the composition, and between 5 and 60% by weight of calcium carbonate with respect to the total dry material weight of the composition, wherein the composition provides a self-extinguishing smoking article having an SE value equal or higher than 75% and a FASE value equal or lower than 15%, and wherein the composition has a viscosity of between 80 and 600 cps, measured with a Brookfield RVT viscometer at room temperature.

13. The method of claim 2, wherein the composition consists of water, between 40% and 95% by weight of gum arabic with respect to the total dry material weight of the composition, and a filler consisting of calcium carbonate and substances selected from the group consisting of kaolin, calcium sulphate, citrate, titanium dioxide and mixtures thereof, wherein the calcium carbonate is present in an amount of between 5% and 60% by weight with respect to the total dry material weight of the composition, wherein the composition provides a self-extinguishing smoking article having an SE value equal or higher than 75% and a FASE value equal or lower than 15%, and wherein the composition has a viscosity of between 80 and 600 cps, measured with a Brookfield RVT viscometer at room temperature.

14. A coated paper wrapper for obtaining a self-extinguishing smoking article, wherein such coated paper wrapper comprises a composition as a total or partial coating, wherein the composition comprises gum arabic and a filler, wherein the filler comprises calcium carbonate alone or in combination with substances selected from the group consisting of kaolin, calcium sulphate, citrate, titanium dioxide and mixtures thereof, wherein the composition comprises:

between 40% and 95% by weight of gum arabic with respect to the total dry material weight of the composition, and between 5% and 60% of calcium carbonate with respect to the total dry material weight of the composition, wherein the composition has a viscosity of between 80 and 600 cps, measured with a Brookfield RVT viscometer at room temperature, wherein the coated paper wrapper wraps a tobacco rod of a smoking article, and wherein the coated paper wrapper provides a self-extinguishing smoking article having an SE value equal or higher than 75% and a FASE value equal or lower than 15%.

15. The coated paper wrapper according to claim 14, wherein such paper wrapper comprises, at least, areas coated with an ink composed by:

a percentage of dry material of between 25 and 40% by weight with respect to the total composition, between 40% and 95% by weight of gum arabic with respect to the dry material weight, between 5 and 60% by weight, of calcium carbonate with respect to the dry material weight, 3.5% by weight, of a combustion agent selected from the group consisting of trisodium citrate, tripotassium citrate, and mixtures thereof, the coated paper wrapper having an initial air permeability of between 10 CU and 150 CU.

16. A self-extinguishing smoking article which comprises the coated paper wrapper defined in claim 14, wherein the coated paper wrapper wraps a tobacco rod of the smoking article, and wherein the coated paper wrapper provides a self-extinguishing smoking article with an SE value equal or higher than 75% and a FASE value equal or lower than 15%.

17. A composition for coating paper wrappers for smoking articles consisting of water, between 40% and 95% by weight of gum arabic with respect to the total dry material weight of the composition, and a filler consisting of calcium carbonate and substances selected from the group consisting of kaolin, calcium sulphate, citrate, titanium dioxide and mixtures thereof, wherein the calcium carbonate is present in an amount of between 5% and 60% by weight with respect to the total dry material weight of the composition, wherein the composition has a viscosity of between 80 and 600 cps, measured with a Brookfield RVT viscometer at room temperature, and wherein a smoking article comprising a paper wrapper coated with the composition is self-extinguishing and has an SE value equal or higher than 75% and a FASE value equal or lower than 15%.

18. The composition according to claim 17, wherein the filler comprises calcium carbonate and a citrate selected from the group consisting of trisodium citrate, tripotassium citrate, and mixtures thereof.

19. A coated paper wrapper for obtaining a self-extinguishing smoking article, wherein such coated paper wrapper comprises the composition defined in claim 1 as a total or partial coating.

20. A coated paper wrapper for obtaining a self-extinguishing smoking article, wherein such coated paper wrapper comprises the composition defined in claim 17 as a total or partial coating.

* * * * *